US006195841B1

(12) United States Patent
Mascheretti et al.

(10) Patent No.: US 6,195,841 B1
(45) Date of Patent: Mar. 6, 2001

(54) DEVICE FOR PREPARATION AND OPENING OF FLOCK FIBERS TO BE SUPPLIED TO A CARDER

(75) Inventors: Mario Mascheretti; Giovanni Battista Pasini, both of Palazzolo Sull 'Oglio (IT)

(73) Assignee: Marzoli S.p.A., Palazzolo Sull 'Oglio (IT)

( * ) Notice: Subject to any disclaimer, the term of this patent is extended or adjusted under 35 U.S.C. 154(b) by 0 days.

(21) Appl. No.: 09/442,645

(22) Filed: Nov. 18, 1999

(30) Foreign Application Priority Data

Nov. 24, 1998 (IT) ..... MI98A2537

(51) Int. Cl.[7] ..... D01G 15/40

(52) U.S. Cl. ..... 19/105; 19/65 R; 19/200

(58) Field of Search ..... 19/65 A, 65 R, 19/105, 200, 202, 203, 204, 205

(56) References Cited

U.S. PATENT DOCUMENTS

| | | | | |
|---|---|---|---|---|
| 4,240,180 | * | 12/1980 | Wood et al. | 19/105 |
| 4,797,979 | * | 1/1989 | Staheli et al. | 19/105 |
| 4,811,463 | * | 3/1989 | Leifeld | 19/105 |
| 5,408,727 | * | 4/1995 | Pinto et al. | 19/105 |
| 5,623,749 | * | 4/1997 | Leifeld et al. | 19/105 |

* cited by examiner

*Primary Examiner*—John J. Calvert
*Assistant Examiner*—Gary L. Welch
(74) *Attorney, Agent, or Firm*—Oblon, Spivak, McClelland, Maier & Neustadt, P.C.

(57) ABSTRACT

Silo for supply of flock fibers to a carder, which silo is subdivided into superimposed chambers, between which there is interposed a set of rollers which regulate the descending flow, and carry out breaking and separation of the fibrous material, in which a supply roller, an auxiliary supply roller and a breaker roller are disposed in a triangle, in which the surface of the auxiliary roller opposite that which is tangent to the supply roller is exposed to the flow of air which descends downwards, together with the fibers worked by the breaker roller.

6 Claims, 3 Drawing Sheets

DEVICE FOR PREPARATION AND OPENING OF FLOCK FIBERS TO BE SUPPLIED TO A CARDER

BACKGROUND OF THE INVENTION

1. Field of the Invention

The present invention relates to supplying carders, in which fibrous flock material is worked by a series of surfaces which are provided with a multiplicity of tips, by which the fibrous material is opened up into the form of individual fibers, the particles of dirt are eliminated, the fibers are mingled with one another, and a strip of non-twisted fibers is formed, to be conveyed to the successive processing stages.

2. Discussion of Background

In its most general outlines, the operation of supply to carders of the cotton-industry type is carried out according to the significant aspects of the diagram illustrated in FIG. 1. The light-coloured arrows indicate the flow of flock fibers,whereas the dark arrows indicate the flow of the conveying and control air.

The untreated material 1 is obtained in general from a opener, not shown in the figure, and includes flock fibers. The supply device includes a vertical silo, which is subdivided into two chambers, one above the other, between which there is interposed a set of rollers which regulate the descending flow, and carry out initial breaking and separation of the material. This fibrous material is conveyed by means of pneumatic transport in an air current, and is accumulated in the end part 2 of the descending duct or upper chamber 3 for intake of the fibers. The transport air is discharged from the apertures 4; as the fibrous material is deposited in the end part 2, it covers these holes, and increases the pressure in the duct 1*a*. Monitoring of the differential pressure value, or load loss, in the upper duct, makes it possible to detect the level of filling of the upper chamber in the end part 2. On the basis of the level of filling of the chamber, there is regulation of the conveyance of flock fibers from the preceding set of openers. If the carding unit consists of several carders in parallel, the flow of fibers, conveyed by the opener unit upstream to the carder downstream, is preferably distributed to the carders which have their ducts 3 least filled, and which thus provide a lower load loss relative to the flow of fibers.

Downstream from the end part 2, there is disposed the supply cylinder or roller 5, which supplies the flock fibers to the breaker cylinder or roller 6, which carries out the breaking of the material. The two cylinders operate with simultaneous rotation, in order to transfer the material in,o the duct 7 beneath.

According to the known art, the supply roller 5 is actuated at a variable speed of rotation, and is produced lobed, or is provided with a covering with saw teeth. In general, the saw-tooth covering is produced with positive angling, i.e. with the steepest edge facing in the direction of feed, with the effect of thrusting the flock fiber towards the tips of the breaker cylinder 6.

The supply roller 5 works facing the wall 2' of the end part 2 of the duct 3 for intake of the fibers 1, in order to create between the roller and the wall a gap 2" for passage of the fibers.

The breaker roller 6 works at a constant linear speed, and is provided with a series of tips or needles 8, which are spaced from one another. The breaker roller 6 works facing the curved wall 9 which surrounds it, in order to create a second gap 9' for passage of the fibers.

The air current in order to maintain the pressure in the lower chamber 10 at the end of the duct 7 is supplied by a blower 11, which provides a flow of air which is tangential relative to the output of the fibers from the breaker cylinder 6, and is then discharged from the holes 12. In the duct 7' there is installed a pressure switch, which controls the speed of rotation of the roller 5, such as to regulate the density of the fibers which are contained in the lower chamber 10, and form the mat supplied to the carder.

The base of the second descending duct 7 is equivalent to conventional storage of fibers in a silo, in which the density of the fibers is controlled and regulated by pneumatic effect. The set of discharge cylinders or lobed rollers 13, which rotate at a controlled speed, in order to regulate the flow of fibers, discharges the fibers onto a slide 14, which supplies the fibers in the form of a mat 15 to the carder.

The transverse dimension of the mat supplied depends on that of the processing cylinders of the carder; for carders of the cotton-industry type, this transverse dimension is in general between 0.7 and 1.5 m, depending on the models.

The supply system according to the known art described hitherto has some problems. Significant amongst these problems is the inefficient opening action by the system, on the flock fibrous material supplied, and particularly when operation takes place with a high level of hourly production of the carder. This reduced efficiency of opening of the flock is caused by poor action of penetration of the tips of the breaker roller, which is carried out only on the fibers which are held between the roller and the wall which surrounds it, which acts as a supply table for the silo. There is also premature wear of the tips of the breaker roller, which must be replaced at brief intervals.

A further disadvantage consists of the formation of neps, or tangles of fibers caused by curling of the fibers as a result of sliding of the latter on the wall 2' opposite the roller 5.

SUMMARY OF THE INVENTION

The present invention relates more particularly to a device for preparation of the supply of flock fibers to a carder, which permits increased production, and at the same time provides more open and homogeneous fibers, which are also worked less aggressively.

The substantial characteristics of the device according to the invention are defined in the first claim, and its preferred embodiments are defined in the dependent claims.

BRIEF DESCRIPTION OF THE DRAWINGS

In order to illustrate more clearly the characteristics and advantages of the present invention, it is described with reference to a typical embodiment shown by way of non-limiting example in FIGS. 1 to 3, which illustrate schematically.

DETAILED DESCRIPTION OF THE EMBODIMENT

Figure 1:
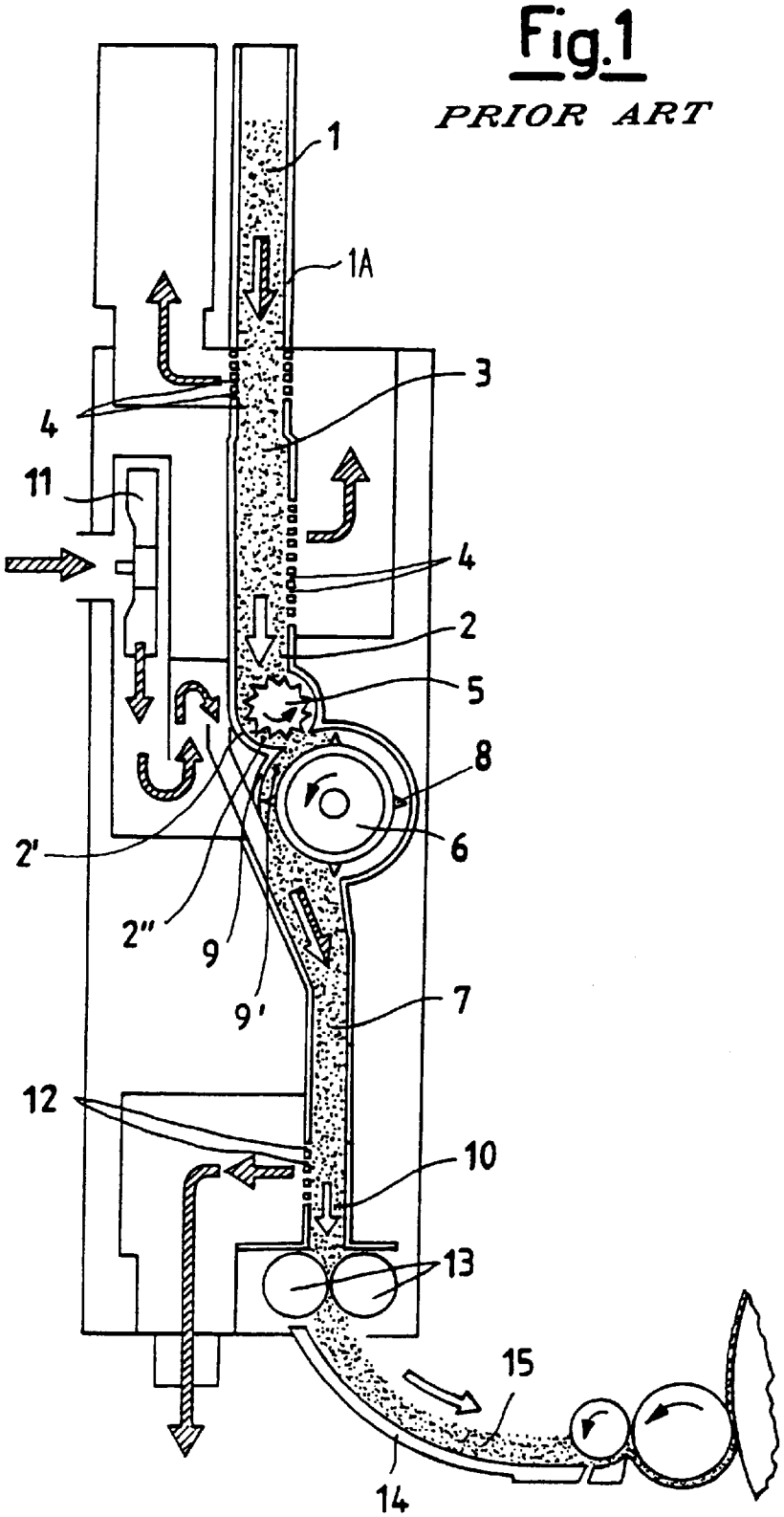
Fig.1 PRIOR ART
FIG. 1 is a cross-sectional view illustrating the state of the art and the technical problem of supply in general to the carder.
Figure 2:
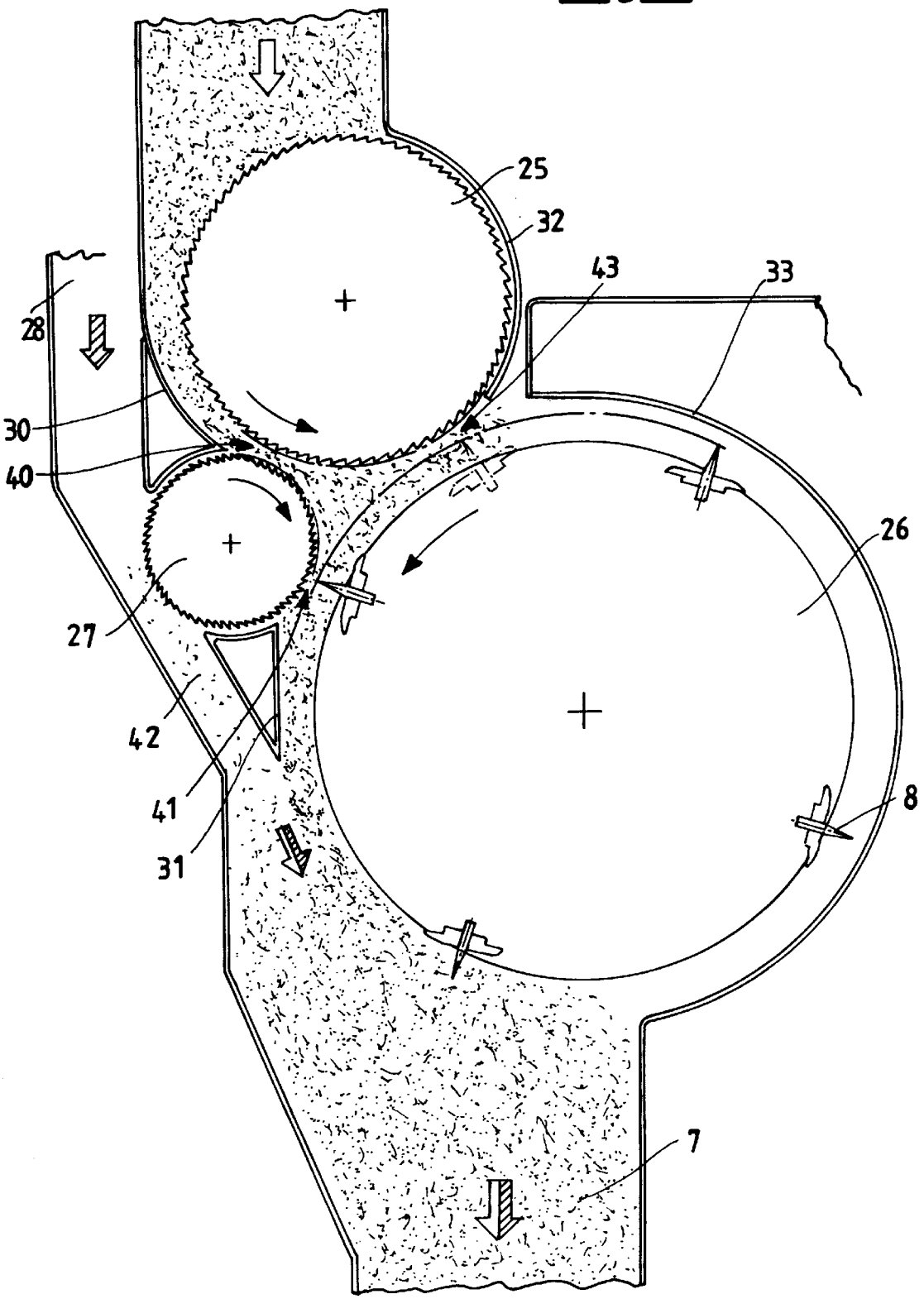
FIG. 2 is a schematic cross-sectional view of the present invention.

In the embodiment illustrated in FIG. 2, a supply roller and a breaker roller are shown on a scale which is enlarged in relation to FIG. 1. The supply roller 25 is disposed at, and upstream from the breaker roller 26, and these two units are disposed in the form of a triangle together with an auxiliary supply roller 27 which is provided with a covering, which for example consists of saw teeth.

The triangle constituted by the three rollers is contained within guide walls, consisting of a wall which ends at the wedge 30 which separates the supply roller 25 and the auxiliary supply roller 27, and a wedge 31 which separates the breaker roller 26 and the auxiliary supply roller 27, whereas at the opposite side, the delimiting walls 32 and 33 have substantially the same configuration and function as in FIG. 1.

Towards the outer part of the said triangle, the surface of the auxiliary supply roller 27 opposite that which is tangent relative to the roller 25, and is free between the two wedges 30 and 31, is exposed to the flow of air obtained from the blower 11 with the duct 28, and moves downwardly together with the fibers worked by the breaker roller 26.

The functioning of the supply unit is designed to break up the material, providing smaller and better opened up flock fibers, and supplying to the chamber 10 beneath a column of fibers which is homogeneous throughout the width of the chamber, in order to obtain a mat with a regular yarn count. The two rollers 25 and 27 are rotated simultaneously, such as to press the fibers together in the passage 40, and thrust them from the upper chamber 3 into the triangle formed by the three rollers through the said passage.

In general, the supply roller 25 and the auxiliary supply roller 27 operate at linear speeds which are substantially the same, and are within the range of 1–6 meters per minute. The distance $d_{40}$ between the tips of the teeth of the supply roller 25 and the auxilliary supply roller 27 is between 3 and 10 mm, and is preferably between 4 and 7 mm.

According to a preferred embodiment of the present invention, the coverings of the supply rollers 25 and the auxilliary supply roller 27 have saw teeth with negative angling, as shown in FIG. 2, i.e. with the steepest edge opposite the direction of advance, with the effect of conveying the fiber flock further towards the tips of the breaker roller 26, but also to retain them between the less inclined edges of the toothing, such that the action of breaking of the flock by the needles 8 of the breaker roller 26 is more efficient.

Most of the fibers which enter the triangle of the rollers go directly to the passage 41 between the breaker roller 26 and the auxiliary supply roller 27, which has a width $d_{41}$. This distance $d_4$, between the tips of the teeth of the auxilliary roller 27 and the needles of the breaker roller 26 is in the interval of 0.5–3 mm. The breaker roller 26 operates at a constant speed, in general of between 800 and 1600 meters per minute, and removes the fibers from the passage 41 towards the lower chamber 10, rotating simultaneously with the auxiliary supply roller 27, which has a linear speed which is substantially lower, and from which the fibers are then removed by the breaker roller 26.

As a result of the preferred use of a saw-tooth covering with negative angling for the auxiliary supply roller 27, in the passage 41 also there is a specific further effect of retention of the fibers, in opposition to the action of the needles 8, such as to obtain in this passage 41 a further effect of breaking of the flock. As a consequence of this action of retention, a small but significant quantity of fibers can remain on the covering of the auxiliary supply roller 27 downstream from the passage 41. The flow of air which travels through the duct 28 makes it possible to release substantially from the covering of the auxilliary supply roller 27 residual fibers which are held downstream from the passage 41, and this action is also assisted by the negative angling of the saw-teeth of the covering.

According to a preferred embodiment of the present invention, the auxiliary supply roller 27 is produced and mounted such as to project substantially from the two wedges 30 and 31, such that in the area 42 of the duct 28 in which there is this contact between the flow of air from the blower 11 and the covering of the auxilliary supply roller 27, there is restriction of the passage 41, and thus a contracted jet of air, which is therefore more efficient in removing the fibers. As an alternative, this restriction of the passage can be obtained by placing a deflection element on the opposite wall of the duct 28.

On the other hand, the fibers which are at the upper part of the triangle within the rollers are removed into the passage 43 between the supply roller 25 and the breaker roller 26, which rotate discordantly relative to one another. In this passage, the needles 8 remove the fibers from the supply roller 25, and convey them to the passage 41 towards the lower chamber 7. The distance $d_{43}$ between the tips of the teeth of the supply roller 25 and the needles of the breaker roller 26 is in the interval of 0.5–1 mm.

Figure 3:
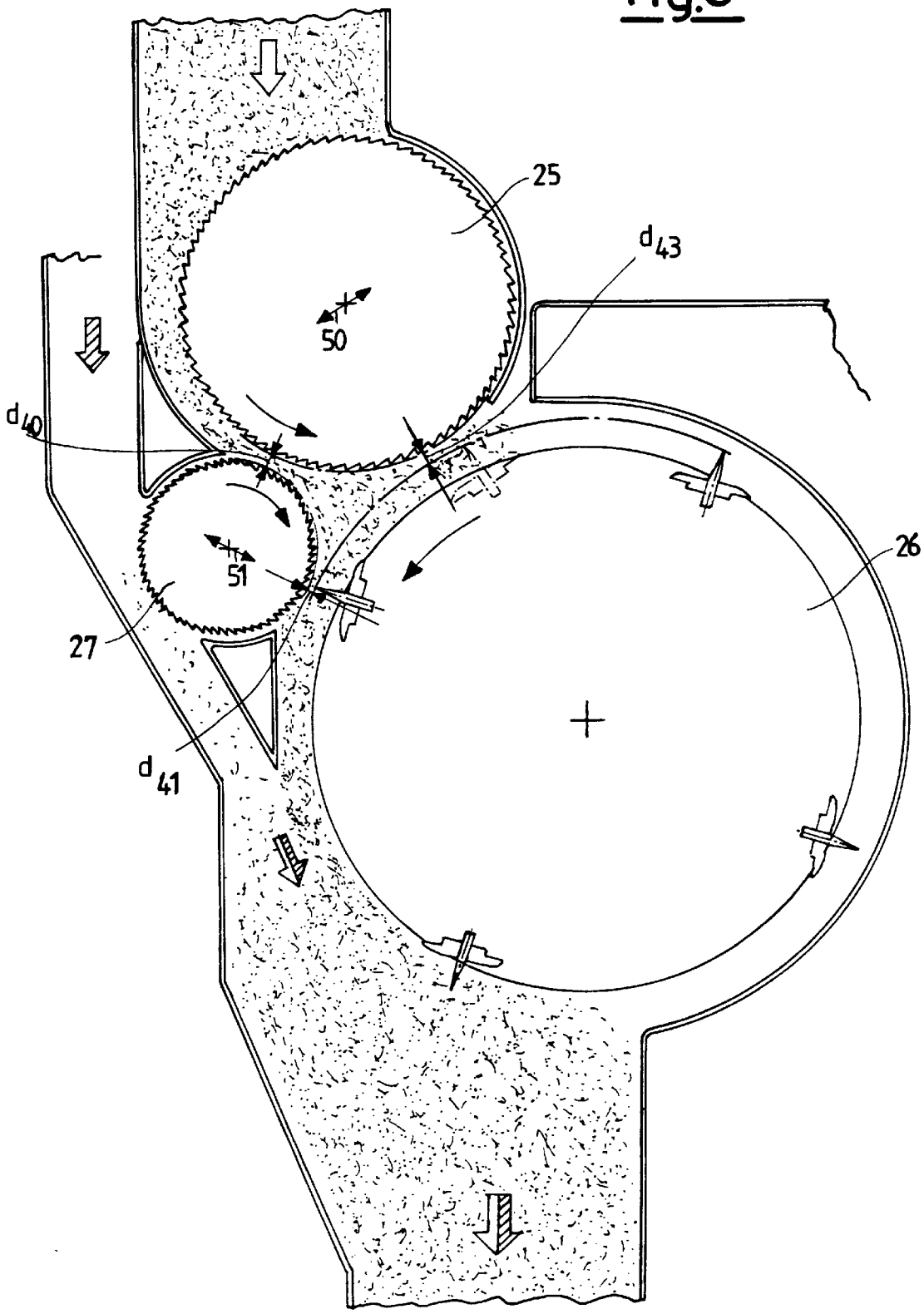
FIG. 3 is a cross-sectional view illustrating a diagram for regulation of the device in FIG. 2.

FIG. 3 shows the diagram for regulation of the supply roller 25, breaker roller 26 and auxilliary supply roller 27. In general, the breaker roller 26 is actuated at a constant, predetermined speed. On the other hand, the two covered supply roller 25 and auxilliary supply roller 27 are actuated at a speed which is variable according to the level of filling of the lower chamber 10 of the silo as a whole, measured as loss of load in the chambers. For each processing operation which is carried out, there is regulation of the reciprocal distances $d_{40}$, $d_{41}$, and $d_{43}$ between the tips of the respective coverings $d_{40}$, $d_{41}$ and $d_{43}$ of the supply roller 25, breaker roller 26, and auxilliary supply roller 27. The position of the axis of rotation of the breaker roller 26 is not modified in general, whereas the position of the two horizontal axes of the supply roller 25 and the auxilliary supply roller 27 can be modified, in order to regulate the distances between the rollers. In particular, the supply roller 25 is regulated by modification of its distance in the meeting point between the centers of the supply roller 25 and the auxilliary supply roller 27, according to the double arrow 50, thus regulating the distance $d_{40}$. On the other hand, the auxiliary supply roller 27 is regulated by modification of its distance in the meeting point between the center of the breaker roller 26 and the auxilliary supply roller 27, according to the double arrow 51, thus regulating the distance $d_{41}$.

By way of example, the positions of the axes of rotation of the supply roller 25 and the auxilliary supply roller 27 can be modified by mounting the horizontal shafts of the supply roller 25 and the auxilliary supply roller 27 on supports which are provided with through slots, which are elongate in the direction of the arrows 50 and 51, and by locking the shafts in their slot in the required position by known means, for example by threading the ends of the shafts and locking them with washers, nuts and counternuts.

In general, for processing with higher productivity, and with fibers which are less tangled and cleaner, operation takes place with larger distances $d_{40}$, $d_{41}$, and $d_{43}$, and consequently with greater lows of fibers, and in general, with lesser differences between the linear speeds of the supply roller 25, the auxilliary supply roller 27 and that of the breaker roller 26.

In this operation there is already release of a significant quantity of dust from the flock fibers, which are discharged together with the flows of air through the slots 12, and do not reach the carder which follows. This characteristic provides the present invention with a significant advantage.

Furthermore, the device according to the present invention makes it possible to eliminate the disadvantages previously described. As far as the action of opening up the flock fibrous material supplied is concerned, even when operation takes place with a high level of hourly production of carding, the action of penetration of the tips of the breaker roller 26, which is exerted between the breaker roller 26 and the covered supply roller 25 and covered auxilliary supply roller 27, is far more efficient than that which can be exerted relative to a surrounding fixed, smooth wall, which brakes the motion of the fibers and does not accompany them. There is also reduced wear of the tips 8 of the breaker roller 26, which can be replaced at longer intervals.

As already stated, the fibers are treated less aggressively, and thus there are fewer broken fibers, although the fibers are well separated and cleaner.

What is claimed as new and desired to be secured by letters patent of the United States is:

1. A device for supplying flock fibers to a carder, comprising:

a vertical silo which is subdivided into an upper chamber located above a lower chamber;

a supply roller and a breaker roller interposed between said upper and lower chambers, wherein together said supply roller and said breaker roller regulate a descending flow of the flock fiber and carry out breaking and separating on the flock fibers;

an auxiliary supply roller which is provided with a covering, wherein said supply roller, said breaker roller, and said auxiliary supply roller each have a central longitudinal axis which forms a point in cross-section;

a triangle formed by said points of said supply roller, said breaker roller, and said auxiliary supply roller, wherein said triangle is contained within guide walls of said upper and lower chambers, wherein a surface of said auxiliary supply roller is opposite to a line tangent to said supply roller, and wherein said surface and the flock fibers broken and separated by said supply roller and said breaker roller are exposed to a flow of air of a duct which descends downwardly approximately parallel to said vertical silo.

2. The device for supplying flock fibers to a carder according to claim 1, further comprising a covering for said supply roller, wherein said covering for said auxiliary supply roller and said covering for said supply roller have saw teeth with negative angling, with a steeper edge opposite to a direction of advance of said auxiliary supply roller and said supply roller.

3. The device for supplying flock fibers to a carder according to claim 1, wherein a distance between tips of teeth of said supply roller and said auxiliary supply roller is in a range of 3–10 mm.

4. The device for supplying flock fibers to a carder according to claim 1, wherein a distance between tips of teeth of said auxiliary supply roller and needles of said supply roller is in a range of 0.5–3 mm.

5. The device for supplying flock fibers to a carder according to claim 1, wherein said auxiliary supply roller is produced and mounted such that in an area of said duct in which there is contact between the flow of air from a blower and said covering of said auxiliary supply roller, there is restriction of said passage, and a contracted jet of air.

6. The device for supplying flock fibers to a carder according to claim 1, wherein a position of a horizontal axes of said supply roller and said auxiliary supply roller is modified, in order to regulate a distance between tips of teeth of said supply roller and said auxiliary supply roller and a distance between tips of teeth of said auxiliary supply roller and needles of said supply roller.

* * * * *